US008219015B2

(12) United States Patent
Shinshi et al.

(10) Patent No.: US 8,219,015 B2
(45) Date of Patent: Jul. 10, 2012

(54) FIXING DEVICE AND IMAGE FORMING APPARATUS INCORPORATING SAME WHICH INCLUDES A PLATE SPRING TO PRESS A LOW-FRICTION SHEET

(75) Inventors: Akira Shinshi, Machida (JP); Hiroshi Yoshinaga, Ichikawa (JP); Kenichi Hasegawa, Atsugi (JP)

(73) Assignee: Ricoh Company, Ltd., Tokyo (JP)

( * ) Notice: Subject to any disclaimer, the term of this patent is extended or adjusted under 35 U.S.C. 154(b) by 239 days.

(21) Appl. No.: 12/685,225

(22) Filed: Jan. 11, 2010

(65) Prior Publication Data

US 2010/0202809 A1 Aug. 12, 2010

(30) Foreign Application Priority Data

Feb. 9, 2009 (JP) ..... 2009-027586

(51) Int. Cl.
*G03G 15/20* (2006.01)

(52) U.S. Cl. ..... 399/329

(58) Field of Classification Search ..... 399/329, 399/330, 331, 333; 219/216
See application file for complete search history.

(56) References Cited

U.S. PATENT DOCUMENTS 5,999,788 A * 12/1999 Kanesawa et al. ..... 399/329
6,131,009 A 10/2000 Hasegawa
6,496,666 B2 12/2002 Hayashi et al.
6,591,081 B2 7/2003 Hasegawa
6,628,916 B2 9/2003 Yasui et al.
6,636,709 B2 10/2003 Furukawa et al.
6,778,790 B2 8/2004 Yoshinaga et al.
6,778,804 B2 8/2004 Yoshinaga et al.
6,881,927 B2 4/2005 Yoshinaga et al.
6,882,820 B2 4/2005 Shinshi et al.
6,892,044 B2 5/2005 Yasui et al.
7,022,944 B2 4/2006 Yoshinaga et al.
7,070,182 B2 7/2006 Hasegawa
7,127,204 B2 10/2006 Satoh et al.
7,151,907 B2 12/2006 Yoshinaga
7,239,838 B2 7/2007 Sato et al.

(Continued)

FOREIGN PATENT DOCUMENTS

JP 2884717 2/1999

(Continued)

OTHER PUBLICATIONS

U.S. Appl. No. 12/575,818, filed Oct. 8, 2009, Akira Shinshi et al.

(Continued)

*Primary Examiner* — Robert Beatty
(74) *Attorney, Agent, or Firm* — Oblon, Spivak, McClelland, Maier & Neustadt, L.L.P.

(57) ABSTRACT

In a fixing device, a fixed member is provided inside a loop formed by a belt member, and is pressed against a rotary member via the belt member to form a nip portion between the rotary member and the belt member through which a recording medium bearing a toner image passes. In the fixed member, a low-friction sheet member is wrapped around a body in a sliding direction of the belt member in which the belt member slides over the fixed member in such a manner that the low-friction sheet member covers a surface of the body opposing the nip portion. At least one plate spring presses the low-friction sheet member against the body to apply a predetermined tension to the low-friction sheet member.

15 Claims, 6 Drawing Sheets

U.S. PATENT DOCUMENTS

| | | | | |
|---|---|---|---|---|
| 7,242,897 | B2 | 7/2007 | Satoh et al. | |
| 7,313,353 | B2 | 12/2007 | Satoh et al. | |
| 7,319,838 | B2 * | 1/2008 | Baba et al. | 399/323 |
| 7,330,682 | B2 | 2/2008 | Shinshi | |
| 7,333,762 | B2 * | 2/2008 | Oishi et al. | 399/329 |
| 7,379,698 | B2 | 5/2008 | Yoshinaga | |
| 7,454,151 | B2 | 11/2008 | Satoh et al. | |
| 7,493,074 | B2 * | 2/2009 | Komuro | 399/328 |
| 7,509,085 | B2 | 3/2009 | Yoshinaga et al. | |
| 7,515,850 | B2 | 4/2009 | Hasegawa | |
| 7,546,049 | B2 | 6/2009 | Ehara et al. | |
| 7,593,680 | B2 | 9/2009 | Shinshi | |
| 7,616,920 | B2 * | 11/2009 | Matsumoto et al. | 399/329 |
| 7,630,652 | B2 | 12/2009 | Hasegawa | |
| 7,962,083 | B2 * | 6/2011 | Takahashi | 399/329 |
| 2005/0220510 | A1 * | 10/2005 | Tsunoda | 399/329 |
| 2006/0029411 | A1 | 2/2006 | Ishii et al. | |
| 2006/0257183 | A1 | 11/2006 | Ehara et al. | |
| 2007/0003334 | A1 | 1/2007 | Shinshi et al. | |
| 2007/0014600 | A1 | 1/2007 | Ishii et al. | |
| 2007/0059003 | A1 | 3/2007 | Shinshi et al. | |
| 2007/0059071 | A1 | 3/2007 | Shinshi et al. | |
| 2007/0292175 | A1 | 12/2007 | Shinshi | |
| 2008/0063443 | A1 | 3/2008 | Yoshinaga et al. | |
| 2008/0112739 | A1 | 5/2008 | Shinshi | |
| 2008/0175633 | A1 | 7/2008 | Shinshi | |
| 2008/0219730 | A1 | 9/2008 | Shinshi | |
| 2008/0253788 | A1 | 10/2008 | Shinshi | |
| 2008/0253789 | A1 | 10/2008 | Yoshinaga et al. | |
| 2008/0298862 | A1 | 12/2008 | Shinshi | |
| 2008/0317532 | A1 | 12/2008 | Ehara et al. | |
| 2009/0067902 | A1 | 3/2009 | Yoshinaga et al. | |
| 2009/0123202 | A1 | 5/2009 | Yoshinaga et al. | |
| 2009/0148204 | A1 | 6/2009 | Yoshinaga et al. | |
| 2009/0169232 | A1 | 7/2009 | Kunii et al. | |
| 2009/0245865 | A1 | 10/2009 | Shinshi et al. | |
| 2009/0311016 | A1 | 12/2009 | Shinshi | |

FOREIGN PATENT DOCUMENTS

| | | | | |
|---|---|---|---|---|
| JP | 3298354 | | | 4/2002 |
| JP | 2004191857 | A | * | 7/2004 |
| JP | 2004233837 | A | * | 8/2004 |
| JP | 4075483 | | | 2/2008 |
| JP | 2008070747 | A | * | 3/2008 |
| JP | 4136708 | | | 6/2008 |
| JP | 2008-158482 | | | 7/2008 |

OTHER PUBLICATIONS

U.S. Appl. No. 12/588,295, filed Oct. 9, 2009.

* cited by examiner

FIXING DEVICE AND IMAGE FORMING APPARATUS INCORPORATING SAME WHICH INCLUDES A PLATE SPRING TO PRESS A LOW-FRICTION SHEET

CROSS-REFERENCE TO RELATED APPLICATION

The present application is based on and claims priority to Japanese Patent Application No. 2009-027586, filed on Feb. 9, 2009, in the Japan Patent Office, which is hereby incorporated herein by reference in its entirety.

BACKGROUND OF THE INVENTION

1. Field of the Invention

Exemplary aspects of the present invention relate to a fixing device and an image forming apparatus, and more particularly, to a fixing device for fixing a toner image on a recording medium and an image forming apparatus including the fixing device.

2. Description of the Related Art

Related-art image foaming apparatuses, such as copiers, facsimile machines, printers, or multifunction printers having at least one of copying, printing, scanning, and facsimile functions, typically form an image on a recording medium (e.g., a transfer sheet) according to image data. Thus, for example, a charger uniformly charges a surface of an image carrier; an optical writer emits a light beam onto the charged surface of the image carrier to form an electrostatic latent image on the image carrier according to the image data; a development device supplies toner to the electrostatic latent image formed on the image carrier to make the electrostatic latent image visible as a toner image; the toner image is directly transferred from the image carrier onto a recording medium or is indirectly transferred from the image carrier onto a recording medium via an intermediate transfer member; a cleaner then cleans the surface of the image carrier after the toner image is transferred from the image carrier onto the recording medium; finally, a fixing device applies heat and pressure to the recording medium bearing the toner image to fix the toner image on the recording medium, thus forming the image on the recording medium.

In one example of the fixing device, a heater serving as a fixed member provided inside a loop formed by a belt member is pressed against a rotary member opposing the belt member to form a nip portion between the belt member and the rotary member. Together, the belt member heated by the heater and the rotary member apply heat and pressure to a recording medium bearing a toner image to fix the toner image on the recording medium as the recording medium passes through the nip portion.

However, over time, as an inner circumferential surface of the belt member slides over the heater, the heater and the belt member may experience wear due to friction generated therebetween. Further, substantial resistance between the belt member and the heater, again due to friction generated therebetween, may require great driving torque, which may in turn pose a risk of generating faulty toner images due to slippage of the belt member, damage to drive gear teeth, or both.

To address those problems, the fixing device may include a low-friction sheet member to reduce the friction of contact between the belt member and the heater. Thus, in one example, a halogen lamp is provided inside a rotary member outside a belt member. A pressing pad serving as a fixed member is provided inside a loop formed by the belt member and is pressed against the rotary member with the belt member in between to form a nip portion between the belt member and the rotary member. As the belt member and the rotary member rotate to nip and feed a recording medium bearing a toner image to fix the toner image on the recording medium, an inner circumferential surface of the belt member slides over the pressing pad. The low-friction sheet member is provided on a slide surface of the pressing pad, that is, a surface of the pressing pad that contacts the inner circumferential surface of the belt member, so that the inner circumferential surface of the belt member slides smoothly over the low-friction sheet member, that is, over the pressing pad. Such an arrangement can reduce wear of the belt member and the pressing pad.

The low-friction sheet member is typically formed of fluorocarbon resin fiber mesh. As such, the low-friction sheet member may not adhere to the pressing pad sufficiently, and therefore the low-friction sheet member may fall off the pressing pad or may be twisted or warped due to friction between the belt member and the low-friction sheet member. Consequently, the recording medium may be creased as the recording medium passes through the nip portion, resulting in formation of a faulty fixed toner image.

To address this problem, the low-friction sheet member may be attached to the pressing pad by using a holding member. However, such a compact mechanism as a fixing device can accommodate only a small holding member due to limited space.

Alternatively, the low-friction sheet member may be provided with a hole through which a screw is passed to secure the low-friction sheet member to the pressing pad. However, stress concentrated on the hole may deform the hole. As a result, the low-friction sheet member may be twisted or warped.

BRIEF SUMMARY OF THE INVENTION

This specification describes below a fixing device according to an exemplary embodiment of the present invention. In one exemplary embodiment of the present invention, the fixing device fixes a toner image on a recording medium, and includes an endless belt member, a rotary member, and a fixed member. The belt member rotates in a predetermined direction. The rotary member is in rotatable contact with an outer circumferential surface of the belt member. The fixed member is provided inside a loop formed by the belt member over which an inner circumferential surface of the belt member slides. The fixed member is pressed against the rotary member via the belt member to form a nip portion between the rotary member and the belt member through which the recording medium bearing the toner image passes.

The fixed member includes a body, a low-friction sheet member, and at least one plate spring. The body opposes the nip portion. The low-friction sheet member is wrapped around the body of the fixed member in a sliding direction in which the belt member slides over the fixed member, in such a manner that the low-friction sheet member covers a surface of the body opposing the nip portion. The at least one plate spring presses the low-friction sheet member against the body with an elastic force to apply a predetermined tension to the low-friction sheet member.

This specification describes below an image forming apparatus according to an exemplary embodiment of the present invention. In one exemplary embodiment of the present invention, the image forming apparatus includes a fixing device for fixing a toner image on a recording medium. The fixing device includes an endless belt member, a rotary member, and a fixed member. The belt member rotates in a predetermined direction. The rotary member is in rotatable contact with an outer circumferential surface of the belt member. The fixed member is provided inside a loop formed by the belt member over which an inner circumferential surface of the belt member slides. The fixed member is pressed against the rotary member via the belt member to form a nip portion between the rotary member and the belt member through which the recording medium bearing the toner image passes.

The fixed member includes a body, a low-friction sheet member, and at least one plate spring. The body opposes the nip portion. The low-friction sheet member is wrapped around the body of the fixed member in a sliding direction in which the belt member slides over the fixed member, in such a manner that the low-friction sheet member covers a surface of the body opposing the nip portion. The at least one plate spring presses the low-friction sheet member against the body with an elastic force to apply a predetermined tension to the low-friction sheet member.

BRIEF DESCRIPTION OF THE DRAWINGS

A more complete appreciation of the invention and the many attendant advantages thereof will be readily obtained as the same becomes better understood by reference to the following detailed description when considered in connection with the accompanying drawings, wherein.

DETAILED DESCRIPTION OF THE INVENTION

Figure 1:
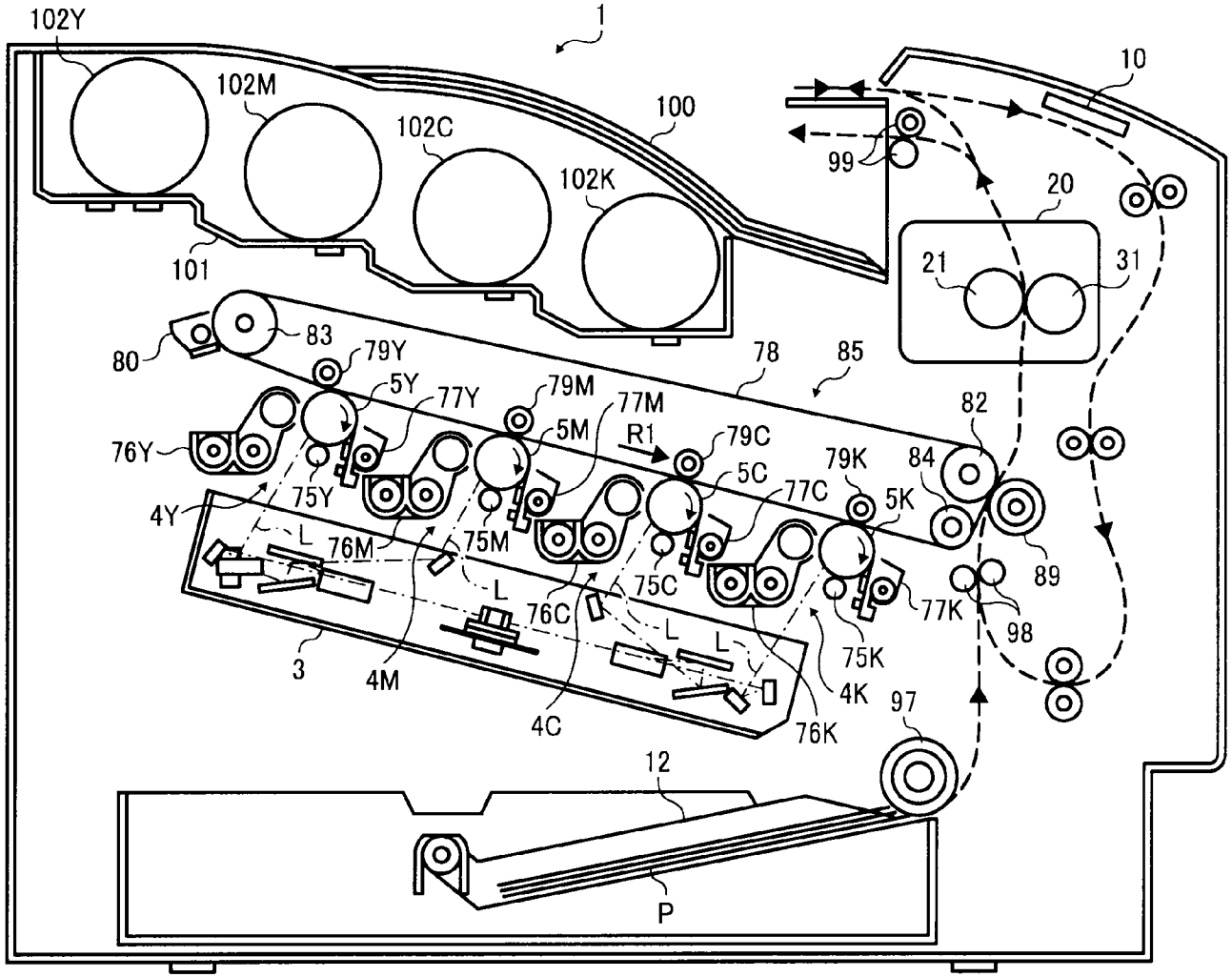
FIG. 1 is a schematic view of an image forming apparatus according to an exemplary embodiment of the present invention.

In describing exemplary embodiments illustrated in the drawings, specific terminology is employed for the sake of clarity. However, the disclosure of this specification is not intended to be limited to the specific terminology so selected and it is to be understood that each specific element includes all technical equivalents that operate in a similar manner.

Referring now to the drawings, wherein like reference numerals designate identical or corresponding parts throughout the several views, in particular to FIG. 1, an image forming apparatus 1 according to an exemplary embodiment of the present invention is explained.

FIG. 1 is a schematic view of the image forming apparatus 1. As illustrated in FIG. 1, the image forming apparatus 1 includes an exposure device 3, image forming devices 4Y, 4M, 4C, and 4K, a controller 10, a paper tray 12, a fixing device 20, an intermediate transfer unit 85, a second transfer roller 89, a feed roller 97, a registration roller pair 98, an output roller pair 99, a stack portion 100, and a toner bottle holder 101.

The image forming devices 4Y, 4M, 4C, and 4K include photoconductive drums 5Y, 5M, 5C, and 5K, chargers 75Y, 75M, 75C, and 75K, development devices 76Y, 76M, 76C, and 76K, and cleaners 77Y, 77M, 77C, and 77K, respectively.

The fixing device 20 includes a fixing belt 21 and a pressing roller 31.

The intermediate transfer unit 85 includes an intermediate transfer belt 78, first transfer bias rollers 79Y, 79M, 79C, and 79K, an intermediate transfer cleaner 80, a second transfer backup roller 82, a cleaning backup roller 83, and a tension roller 84.

The toner bottle holder 101 includes toner bottles 102Y, 102M, 102C, and 102K.

As illustrated in FIG. 1, the image forming apparatus 1 can be a copier, a facsimile machine, a printer, a multifunction printer having at least one of copying, printing, scanning, plotter, and facsimile functions, or the like. According to this exemplary embodiment of the present invention, the image forming apparatus 1 functions as a tandem color printer for forming a color image on a recording medium.

The toner bottle holder 101 is provided in an upper portion of the image forming apparatus 1. The four toner bottles 102Y, 102M, 102C, and 102K contain yellow, magenta, cyan, and black toners, respectively, and are detachably attached to the toner bottle holder 101 so that the toner bottles 102Y, 102M, 102C, and 102K are replaced with new ones, respectively.

The intermediate transfer unit 85 is provided below the toner bottle holder 101. The image forming devices 4Y, 4M, 4C, and 4K are arranged to oppose the intermediate transfer belt 78 of the intermediate transfer unit 85, and form yellow, magenta, cyan, and black toner images, respectively.

In the image forming devices 4Y, 4M, 4C, and 4K, the chargers 75Y, 75M, 75C, and 75K, the development devices 76Y, 76M, 76C, and 76K, the cleaners 77Y, 77M, 77C, and 77K, and dischargers surround the photoconductive drums 5Y, 5M, 5C, and 5K, respectively. Image forming processes including a charging process, an exposure process, a development process, a transfer process, and a cleaning process are performed on the photoconductive drums 5Y, 5M, 5C, and 5K to form yellow, magenta, cyan, and black toner images on the photoconductive drums 5Y, 5M, 5C, and 5K, respectively.

A driving motor drives and rotates the photoconductive drums 5Y, 5M, 5C, and 5K clockwise in FIG. 1. In the charging process, the chargers 75Y, 75M, 75C, and 75K uniformly charge surfaces of the photoconductive drums 5Y, 5M, 5C, and 5K at charging positions at which the chargers 75Y, 75M, 75C, and 75K oppose the photoconductive drums 5Y, 5M, 5C, and 5K, respectively.

In the exposure process, the exposure device 3 emits laser beams L onto the charged surfaces of the photoconductive drums 5Y, 5M, 5C, and 5K, respectively. In other words, the exposure device 3 scans and exposes the charged surfaces of the photoconductive drums 5Y, 5M, 5C, and 5K at irradiation positions at which the exposure device 3 opposes and irradiates the charged surfaces of the photoconductive drums 5Y, 5M, 5C, and 5K to form electrostatic latent images corresponding to yellow, magenta, cyan, and black colors, respectively.

In the development process, the development devices 76Y, 76M, 76C, and 76K make the electrostatic latent images formed on the surfaces of the photoconductive drums 5Y, 5M, 5C, and 5K visible as yellow, magenta, cyan, and black toner images at development positions at which the development devices 76Y, 76M, 76C, and 76K oppose the photoconductive drums 5Y, 5M, 5C, and 5K, respectively.

In the transfer process, the first transfer bias rollers 79Y, 79M, 79C, and 79K transfer and superimpose the yellow, magenta, cyan, and black toner images formed on the photoconductive drums 5Y, 5M, 5C, and 5K onto the intermediate transfer belt 78 at first transfer positions at which the first transfer bias rollers 79Y, 79M, 79C, and 79K oppose the photoconductive drums 5Y, 5M, 5C, and 5K via the intermediate transfer belt 78, respectively. Thus, a color toner image is formed on the intermediate transfer belt 78. After the transfer of the yellow, magenta, cyan, and black toner images, a slight amount of residual toner, which has not been transferred onto the intermediate transfer belt 78, remains on the photoconductive drums 5Y, 5M, 5C, and 5K.

In the cleaning process, cleaning blades included in the cleaners 77Y, 77M, 77C, and 77K mechanically collect the residual toner from the photoconductive drums 5Y, 5M, 5C, and 5K at cleaning positions at which the cleaners 77Y, 77M, 77C, and 77K oppose the photoconductive drums 5Y, 5M, 5C, and 5K, respectively.

Finally, dischargers remove residual potential on the photoconductive drums 5Y, 5M, 5C, and 5K at discharging positions at which the dischargers oppose the photoconductive drums 5Y, 5M, 5C, and 5K, respectively. Thus, a series of image forming processes performed on the photoconductive drums 5Y, 5M, 5C, and 5K is finished.

The intermediate transfer belt 78 is supported by and looped over three rollers, which are the second transfer backup roller 82, the cleaning backup roller 83, and the tension roller 84. A single roller, that is, the second transfer backup roller 82, drives and endlessly moves (e.g., rotates) the intermediate transfer belt 78 in a direction R1.

The four first transfer bias rollers 79Y, 79M, 79C, and 79K and the photoconductive drums 5Y, 5M, 5C, and 5K sandwich the intermediate transfer belt 78 to faun first transfer nip portions, respectively. The first transfer bias rollers 79Y, 79M, 79C, and 79K are applied with a transfer bias having a polarity opposite to a polarity of toner forming the yellow, magenta, cyan, and black toner images on the photoconductive drums 5Y, 5M, 5C, and 5K, respectively. Accordingly, the yellow, magenta, cyan, and black toner images formed on the photoconductive drums 5Y, 5M, 5C, and 5K, respectively, are transferred and superimposed onto the intermediate transfer belt 78 rotating in the direction R1 successively at the first transfer nip portions formed between the photoconductive drums 5Y, 5M, 5C, and 5K and the intermediate transfer belt 78. Thus, the color toner image is formed on the intermediate transfer belt 78.

The paper tray 12 is provided in a lower portion of the image forming apparatus 1, and loads a plurality of transfer sheets P serving as recording media. The feed roller 97 rotates counterclockwise in FIG. 1 to feed an uppermost transfer sheet P of the plurality of transfer sheets P loaded on the paper tray 12 toward the registration roller pair 98.

The registration roller pair 98, which stops rotating temporarily, stops the uppermost transfer sheet P fed by the feed roller 97. For example, a roller nip portion formed between two rollers of the registration roller pair 98 contacts and stops a leading edge of the transfer sheet P. The registration roller pair 98 resumes rotating to feed the transfer sheet P to a second transfer nip portion formed between the second transfer roller 89 and the intermediate transfer belt 78 at a time at which the color toner image formed on the intermediate transfer belt 78 reaches the second transfer nip portion.

At the second transfer nip portion, the second transfer roller 89 and the second transfer backup roller 82 sandwich the intermediate transfer belt 78. The second transfer roller 89 transfers the color toner image formed on the intermediate transfer belt 78 onto the transfer sheet P fed by the registration roller pair 98 at the second transfer nip portion formed between the second transfer roller 89 and the intermediate transfer belt 78. Thus, the desired color toner image is formed on the transfer sheet P. After the transfer of the color toner image, residual toner, which has not been transferred onto the transfer sheet P, remains on the intermediate transfer belt 78.

The intermediate transfer cleaner 80 collects the residual toner from the intermediate transfer belt 78 at a cleaning position at which the intermediate transfer cleaner 80 opposes the intermediate transfer belt 78.

Thus, a series of transfer processes performed on the intermediate transfer belt 78 is finished.

The transfer sheet P bearing the color toner image is sent to the fixing device 20. In the fixing device 20, the fixing belt 21 and the pressing roller 31 apply heat and pressure to the transfer sheet P to fix the color toner image on the transfer sheet P.

Thereafter, the fixing device 20 feeds the transfer sheet P bearing the fixed color toner image toward the output roller pair 99. The output roller pair 99 discharges the transfer sheet P to an outside of the image forming apparatus 1, that is, the stack portion 100. Thus, the transfer sheets P discharged by the output roller pair 99 are stacked on the stack portion 100 successively. Accordingly, a series of image forming processes performed by the image forming apparatus 1 is finished.

The controller 10 controls operations of the image forming apparatus 1.

Referring to FIGS. 2 to 8, the following describes a structure and operations of the fixing device 20.

Figure 2:
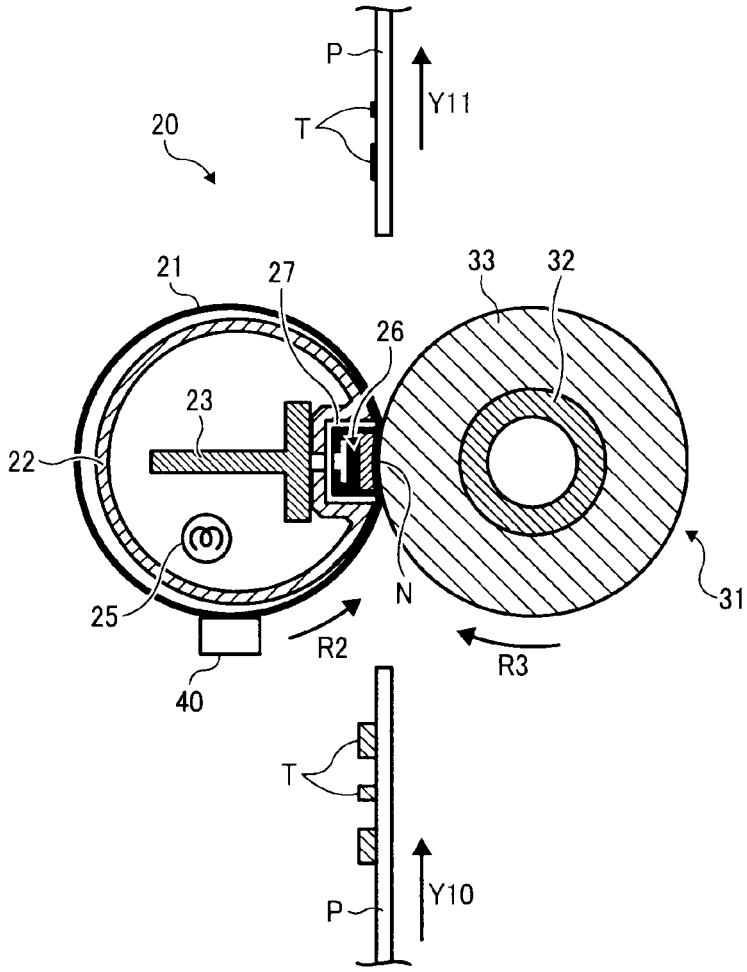
FIG. 2 is a schematic view of a fixing device included in the image forming apparatus shown in FIG. 1.

FIG. 2 is a schematic view of the fixing device 20. As illustrated in FIG. 2, the fixing device 20 further includes a heating member 22, a reinforcement member 23, a heater 25, a fixed member 26, a heat insulator 27, and a temperature sensor 40.

The pressing roller 31 includes a core metal 32 and an elastic layer 33.

Figure 3:
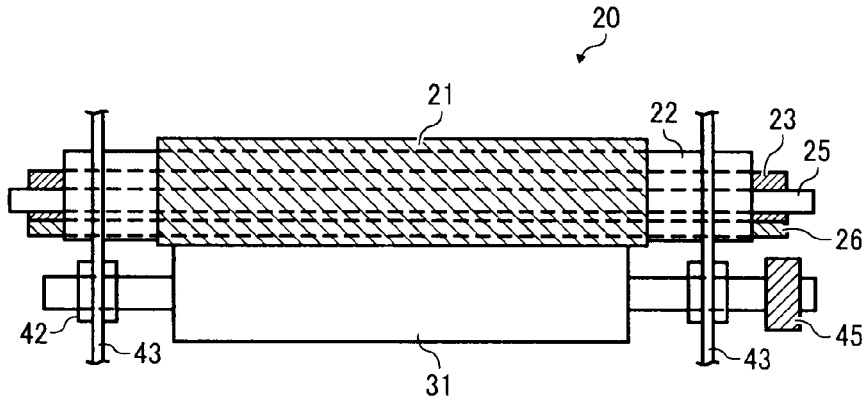
FIG. 3 is an axial view of the fixing device shown in FIG. 2 in a width direction of the fixing device.

FIG. 3 is an axial view of the fixing device 20 in a width direction of the fixing device 20. As illustrated in FIG. 3, the fixing device 20 further includes bearings 42, side plates 43, and a gear 45.

Figure 4:
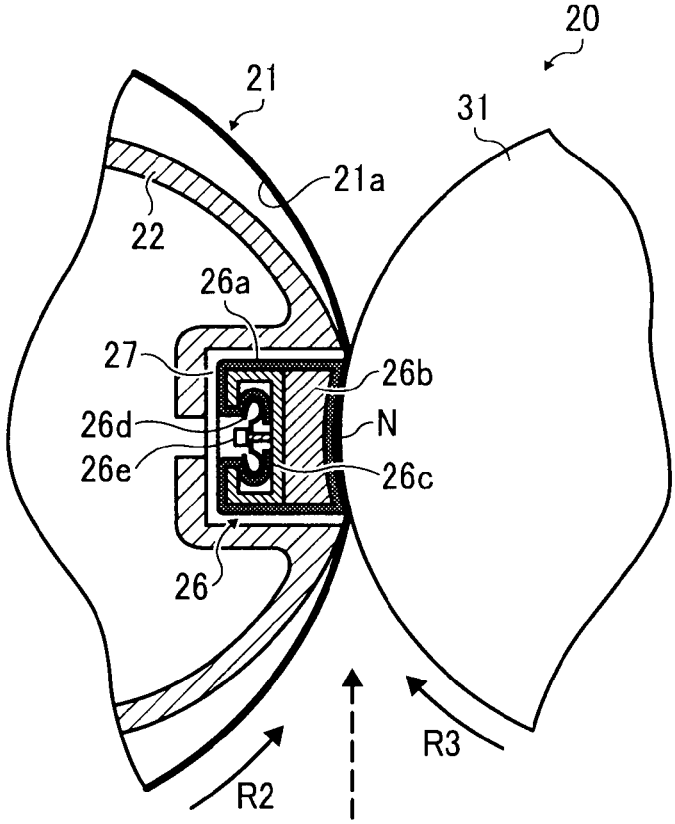
FIG. 4 is a partially enlarged view of the fixing device shown in FIG. 2.

FIG. 4 is a partially enlarged view of the fixing device 20. As illustrated in FIG. 4, the fixing belt 21 includes an inner surface layer 21*a*. The fixed member 26 includes a low-friction sheet member 26*a*, a body 26*b*, a stay 26*c*, a plate spring 26*d*, and a screw 26*e*.

Figure 5:
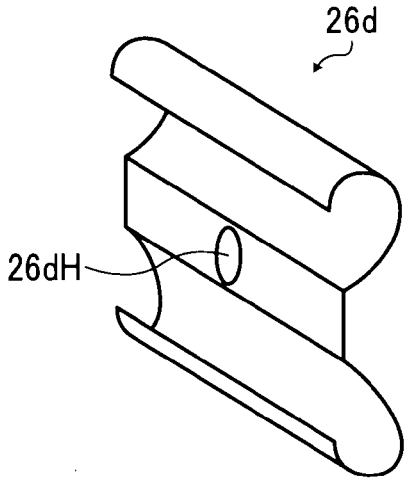
FIG. 5 is a perspective view of a plate spring included in the fixing device shown in FIG. 4.

FIG. 5 is a perspective view of the plate spring 26*d*. As illustrated in FIG. 5, the plate spring 26*d* includes a hole 26*d*H.

Figure 6A:
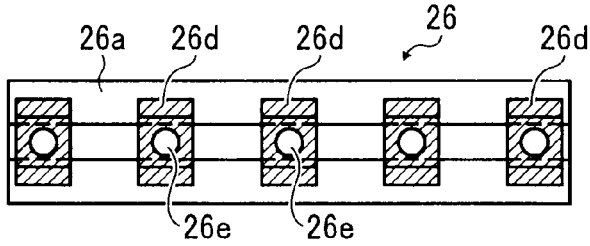
FIG. 6A is a schematic view of one example of the plate spring shown in FIG. 5.
Figure 6B:
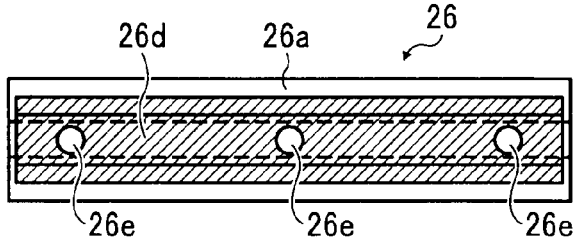
FIG. 6B is a schematic view of another example of the plate spring shown in FIG. 5.

FIGS. 6A and 6B illustrate a schematic view of the fixed member 26 in which the low-friction sheet member 26*a* is held or supported by the plate spring 26*d* in a width direction of the low-friction sheet member 26*a*.

Figure 7A:
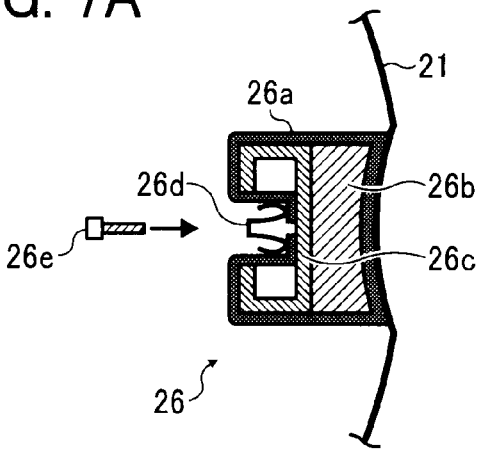
FIG. 7A is an axial end view of a fixing belt and a fixed member included in the fixing device shown in FIG. 4 before the plate spring shown in FIG. 5 is attached to the fixed member.
Figure 7B:
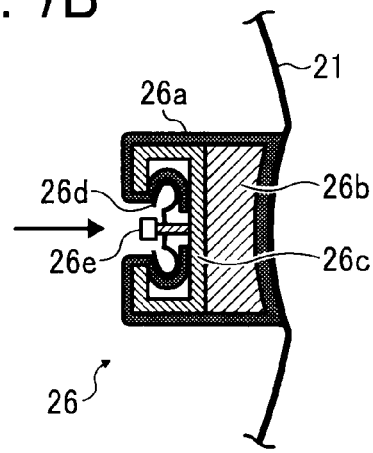
FIG. 7B is an axial end view of a fixing belt and a fixed member included in the fixing device shown in FIG. 4 after the plate spring shown in FIG. 5 is attached to the fixed member.

FIGS. 7A and 7B illustrate an axial end view of the fixing belt 21 and the fixed member 26 showing the plate spring 26*d* being attached to the fixed member 26.

Figure 8:
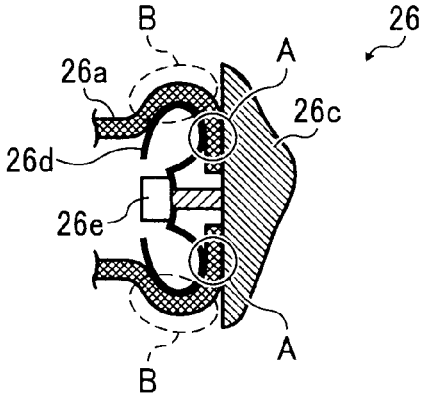
FIG. 8 is an enlarged view of the fixed member shown in FIG. 7B.

FIG. 8 is an enlarged view of the fixed member 26.

As illustrated in FIG. 2, the fixing belt 21 serves as a thin endless belt member which is flexible and bendable, and rotates or moves counterclockwise in FIG. 2 in a rotation direction R2. The fixing belt 21 includes the inner surface layer 21*a* (depicted in FIG. 4), a base layer, an elastic layer, and a releasing layer in such a manner that the inner surface layer 21*a*, the base layer, the elastic layer, and the releasing layer are layered in this order from an inner circumferential surface (e.g., the inner surface layer 21*a*) sliding over the fixed member 26 to an outer circumferential surface so that the fixing belt 21 has a thickness not greater than about 1 mm.

The inner surface layer 21*a*, that is, the inner circumferential surface of the fixing belt 21, has a layer thickness not greater than about 50 μm, and includes a material containing fluorine. For example, the inner surface layer 21*a* may include a fluoroplastic material such as PFA (tetrafluoroethylene-perfluoroalkyl vinyl ether copolymer), PTFE (polytetrafluoroethylene), and/or FEP (tetrafluoroethylene-hexafluoropropylene copolymer), and/or a material containing the above fluoroplastic mixed with resin such as polyimide, polyamide, and/or polyamideimide.

The base layer of the fixing belt 21 has a layer thickness in a range from about 30 μm to about 50 μm, and includes a metal material such as nickel and/or stainless steel, and/or a resin material such as polyimide.

The elastic layer of the fixing belt 21 has a layer thickness in a range from about 100 μm to about 300 μm, and includes a rubber material such as silicon rubber, silicon rubber foam, and/or fluorocarbon rubber. The elastic layer prevents or reduces slight surface asperities of the fixing belt 21 generating at a nip portion N formed between the fixing belt 21 and the pressing roller 31. Accordingly, heat is uniformly transmitted from the fixing belt 21 to a toner image T on a transfer sheet P, suppressing formation of a rough image such as an orange peel image.

The releasing layer of the fixing belt 21 has a layer thickness in a range from about 10 μm to about 50 μm, and includes PFA, PTFE, polyimide, polyetherimide, and/or PES (polyether sulfide). The releasing layer releases or separates a toner image T from the fixing belt 21.

The fixing belt 21 has a diameter in a range from about 15 mm to about 120 mm. According to this exemplary embodiment, the fixing belt 21 has a diameter of about 30 mm.

As illustrated in FIGS. 2 and 4, the fixed member 26, the heater 25, the heating member 22, the reinforcement member 23, and the heat insulator 27 are fixedly provided inside a loop formed by the fixing belt 21 serving as a belt member. In other words, the fixed member 26, the heater 25, the heating member 22, the reinforcement member 23, and the heat insulator 27 do not face the outer circumferential surface of the fixing belt 21, but face the inner circumferential surface of the fixing belt 21.

As illustrated in FIG. 4, the body 26*b* of the fixed member 26 is fixedly provided inside the loop formed by the fixing belt 21 in such a manner that the inner circumferential surface of the fixing belt 21 slides over the body 26*b* via the low-friction sheet member 26*a*. The body 26*b* has a generally rectangular shape, and long sides of the rectangular shape are disposed perpendicular to a sliding direction of the fixing belt 21 sliding over the fixed member 26. A lubricant such as fluorine grease and/or silicon grease is provided between the low-friction sheet member 26*a* and the fixing belt 21. The fixed member 26 is pressed against the pressing roller 31, serving as a rotary member, via the fixing belt 21 to form the nip portion N between the fixing belt 21 and the pressing roller 31 through which a transfer sheet P is conveyed.

As illustrated in FIG. 3, both ends of the fixed member 26 in a width direction of the fixed member 26, that is, in an axial direction of the fixing belt 21, are fixedly supported by the side plates 43 of the fixing device 20, respectively.

As illustrated in FIG. 4, a slide resistance of a surface of the low-friction sheet member 26*a* is lower than at least a slide resistance of the body 26*b* of the fixed member 26.

As illustrated in FIG. 2, the heating member 22 opposes the inner circumferential surface of the fixing belt 21 at a position other than the nip portion N. At the nip portion N, the heating member 22 holds or supports the fixed member 26 via the heat insulator 27. As illustrated in FIG. 3, both ends of the heating member 22 in a width direction of the heating member 22, that is, in the axial direction of the fixing belt 21, are fixedly supported by the side plates 43 of the fixing device 20, respectively.

The heating member 22 is heated by radiation heat of the heater 25 depicted in FIG. 2, and transmits the radiation heat to the fixing belt 21 to heat the fixing belt 21. In other words, the heater 25 directly heats the heating member 22, and the fixing belt 21 is indirectly heated by the heater 25 via the heating member 22. The heating member 22 may include metallic thermal conductor, that is, metal having thermal conductivity, such as aluminum, iron, and/or stainless steel.

The heater 25, serving as a heater or a heat source, includes a halogen heater and/or a carbon heater. As illustrated in FIG. 3, both ends of the heater 25 in a width direction of the heater 25, that is, in the axial direction of the fixing belt 21, are fixedly mounted on the side plates 43 of the fixing device 20. Radiation heat generated by the heater 25, which is controlled by a power source provided in the image forming apparatus 1 depicted in FIG. 1, heats the heating member 22. The heating member 22 heats a substantially whole portion of the fixing belt 21. In other words, the heating member 22 heats a portion of the fixing belt 21 other than the nip portion N. Heat is transmitted from the heated outer circumferential surface of the fixing belt 21 to a toner image T on a transfer sheet P.

As illustrated in FIG. 2, the temperature sensor 40, such as a thermistor, opposes the outer circumferential surface of the fixing belt 21 to detect temperature of the outer circumferential surface of the fixing belt 21. The controller 10 depicted in FIG. 1 controls the heater 25 according to a detection result provided by the temperature sensor 40 so as to adjust the temperature (e.g., a fixing temperature) of the fixing belt 21 to a desired temperature.

As described above, in the fixing device 20 according to this exemplary embodiment, the heating member 22 does not heat a small part of the fixing belt 21 but heats a substantial region of the fixing belt 21 in a circumferential direction of the fixing belt 21. Accordingly, even when the image forming apparatus 1 depicted in FIG. 1 forms a toner image at high speed, the fixing belt 21 is heated sufficiently to suppress fixing failure. In other words, the relatively simple structure of the fixing device 20 heats the fixing belt 21 efficiently, resulting in a shortened warm-up time period, a shortened first print time period, and the compact image forming apparatus 1.

A gap δ formed between the fixing belt 21 and the heating member 22 at a position other than the nip portion N may have a size greater than 0 mm and not greater than 1 mm, which is shown as 0 mm<δ≦1 mm. Accordingly, the fixing belt 21 does not slidably contact the heating member 22 at an increased area, suppressing wear of the fixing belt 21. Further, a substantial clearance is not provided between the heating member 22 and the fixing belt 21, suppressing decrease in heating efficiency for heating the fixing belt 21. Moreover, the heating member 22 disposed close to the fixing belt 21 maintains the circular loop formed by the flexible fixing belt 21, decreasing degradation and damage of the fixing belt 21 due to deformation of the fixing belt 21.

As illustrated in FIG. 4, the inner surface layer 21*a* including fluorine is provided as the inner circumferential surface of the fixing belt 21, and a lubricant, such as fluorine grease and/or silicon oil, is applied between the fixing belt 21 and the heating member 22, so as to decrease wear of the fixing belt 21 even when the fixing belt 21 slidably contacts the heating member 22. Further, a slide-contact surface of the heating member 22 may include a low friction material.

According to this exemplary embodiment, the heating member 22 has a substantially circular shape in cross-section. Alternatively, the heating member 22 may have a polygonal shape in cross-section.

As illustrated in FIG. 2, the reinforcement member 23 supports and reinforces the fixed member 26 which forms the nip portion N between the fixing belt 21 and the pressing roller 31. The reinforcement member 23 is fixedly provided inside the loop formed by the fixing belt 21 and faces the inner circumferential surface of the fixing belt 21.

As illustrated in FIG. 3, width of the reinforcement member 23 in a width direction of the reinforcement member 23, that is, in the axial direction of the fixing belt 21, is equivalent to width of the fixed member 26 in the width direction of the fixed member 26, that is, in the axial direction of the fixing belt 21. Both ends of the reinforcement member 23 in the width direction of the reinforcement member 23, that is, in the axial direction of the fixing belt 21, are fixedly mounted on the side plates 43 of the fixing device 20 in such a manner that the side plates 43 support the reinforcement member 23. As illustrated in FIG. 2, the reinforcement member 23 is pressed against the pressing roller 31 via the fixed member 26 and the fixing belt 21. Thus, the fixed member 26 may not be deformed substantially when the fixed member 26 receives pressure applied by the pressing roller 31 at the nip portion N.

In order to provide the above-described functions, the reinforcement member 23 may include a metal material, such as stainless steel and/or iron, providing a high mechanical strength. An opposing surface of the reinforcement member 23 opposing the heater 25 may include a heat insulation material partially or wholly. Alternatively, the opposing surface of the reinforcement member 23 opposing the heater 25 may be mirror-ground. Accordingly, heat output by the heater 25 toward the reinforcement member 23 to heat the reinforcement member 23 is used to heat the heating member 22, improving heating efficiency for heating the heating member 22 and the fixing belt 21.

As illustrated in FIG. 2, the pressing roller 31 serves as a rotary member for contacting the outer circumferential surface of the fixing belt 21 at the nip portion N. The pressing roller 31 has a diameter of about 30 mm. In the pressing roller 31, the elastic layer 33 is provided on the hollow core metal 32. The elastic layer 33 includes silicon rubber foam, silicon rubber, and/or fluorocarbon rubber. A thin releasing layer including PFA and/or PTFE may be provided on the elastic layer 33 to serve as a surface layer. The pressing roller 31 is pressed against the fixing belt 21 to form the desired nip portion N between the pressing roller 31 and the fixing belt 21.

As illustrated in FIG. 3, the gear 45 engaging a driving gear of a driving mechanism is mounted on the pressing roller 31 to rotate the pressing roller 31 clockwise in FIG. 2 in a rotation direction R3. Both ends of the pressing roller 31 in a width direction of the pressing roller 31, that is, in an axial direction of the pressing roller 31, are rotatably supported by the side plates 43 of the fixing device 20 via the bearings 42, respectively. A heat source, such as a halogen heater, may be provided inside the pressing roller 31.

When the elastic layer 33 of the pressing roller 31 includes a sponge material such as silicon rubber foam, the pressing roller 31 applies decreased pressure to the nip portion N to decrease bending of the heating member 22. Further, the pressing roller 31 provides increased heat insulation, and therefore heat is not transmitted from the fixing belt 21 to the pressing roller 31 easily, improving heating efficiency for heating the fixing belt 21.

According to this exemplary embodiment, the diameter of the fixing belt 21 is equivalent to the diameter of the pressing roller 31. Alternatively, the diameter of the fixing belt 21 may be smaller than the diameter of the pressing roller 31. In this case, a curvature of the fixing belt 21 is smaller than a curvature of the pressing roller 31 at the nip portion N, and therefore a transfer sheet P separates from the fixing belt 21 easily when the transfer sheet P is fed out of the nip portion N.

Referring to FIG. 2, the following describes operations of the fixing device 20 having the above-described structure.

When the image forming apparatus 1 depicted in FIG. 1 is powered on, power is supplied to the heater 25, and the pressing roller 31 starts rotating in the rotation direction R3. Accordingly, friction between the pressing roller 31 and the fixing belt 21 rotates the fixing belt 21 in the rotation direction R2. In other words, the fixing belt 21 is driven by the rotating pressing roller 31.

Thereafter, a transfer sheet P is sent from the paper tray 12 (depicted in FIG. 1) toward the second transfer roller 89 (depicted in FIG. 1) so that a color toner image (e.g., a toner image T) is transferred from the intermediate transfer belt 78 (depicted in FIG. 1) onto the transfer sheet P. A guide guides the transfer sheet P bearing the toner image T in a direction Y10 so that the transfer sheet P bearing the toner image T enters the nip portion N formed between the fixing belt 21 and the pressing roller 31 pressed against the fixing belt 21.

The fixing belt 21 heated by the heater 25 via the heating member 22 applies heat to the transfer sheet P bearing the toner image T. Simultaneously, the fixed member 26 reinforced by the reinforcement member 23 and the pressing roller 31 apply pressure to the transfer sheet P bearing the toner image T. Thus, the heat and the pressure fix the toner image T on the transfer sheet P.

Thereafter, the transfer sheet P bearing the fixed toner image T is sent out of the nip portion N and conveyed in a direction Y11.

Referring to FIG. 4, the following describes detailed structure and operations of the fixed member 26 and the fixing belt 21 included in the fixing device 20 according to this exemplary embodiment.

The fixed member 26 is slidably contacted by the inner circumferential surface, that is, the inner surface layer 21*a*, of the fixing belt 21. The low-friction sheet member 26*a* wraps a surface of the fixed member 26. The fixed member 26 includes the low-friction sheet member 26*a*, the body 26*b*, the stay 26*c*, the plate spring 26*d*, and the screw 26*e*. An opposing surface (e.g., a slide-contact surface) of the body 26*b* of the fixed member 26, which opposes the pressing roller 31, has a concave shape to correspond to the curvature of the pressing roller 31. Accordingly, a transfer sheet P bearing a fixed toner image T is sent out of the nip portion N along the curvature of the pressing roller 31. Thus, the transfer sheet P does not adhere to the fixing belt 21 and separates from the fixing belt 21 easily.

According to this exemplary embodiment, a portion of the body 26*b* of the fixed member 26 which forms the nip portion N has the concave shape. Alternatively, the portion of the body 26*b* which forms the nip portion N may have a planar shape. For example, the slide-contact surface, that is, the opposing surface of the fixed member 26 opposing the pressing roller 31 may have the planar shape. Accordingly, the nip portion N is substantially parallel to an image surface of the transfer sheet P, and therefore the transfer sheet P adheres to the fixing belt 21 closely, improving fixing property. Further, the increased curvature of the fixing belt 21 at an exit of the nip portion N separates the transfer sheet P sent out of the nip portion N from the fixing belt 21 easily.

The body 26*b* of the fixed member 26 includes a rigid material such as rigid metal and/or rigid ceramic so that the fixed member 26 is not bent substantially by pressure applied by the pressing roller 31.

The heating member 22 has a substantially pipe shape formed by bending a metal plate. The heating member 22 may have a thin thickness to shorten a warm-up time period. However, the heating member 22 having a small rigidity may be bent or deformed by pressure applied by the pressing roller 31. The deformed heating member 22 may not provide a desired nip length, degrading fixing property. To address this, according to this exemplary embodiment, the body 26*b* of the fixed member 26 having a great rigidity is provided separately from the thin heating member 22 to form the nip portion N.

The heat insulator 27 is provided between the fixed member 26 and the heater 25 depicted in FIG. 2. Specifically, the heat insulator 27 is provided between the fixed member 26 and the heating member 22 to cover the surface of the fixed member 26 other than the slide-contact surface of the fixed member 26 slidably contacted by the fixing belt 21. The heat insulator 27 may include insulative sponge rubber and/or blank ceramic.

According to this exemplary embodiment, the fixing belt 21 is provided close to the heating member 22 in a substantially whole circumference. Accordingly, even in a standby mode before printing starts, the fixing belt 21 is heated uniformly in the circumferential direction of the fixing belt 21. Namely, as soon as the image forming apparatus 1 depicted in FIG. 1 receives a print request, the image forming apparatus 1 can start printing. On the other hand, in a conventional on-demand fixing device providing a short warm-up time period, when heat is applied to a deformed pressing roller at a nip portion in the standby mode, rubber of the pressing roller may degrade due to heat, resulting in a shortened life or permanent distortion under compression of the pressing roller. For example, when heat is applied to deformed rubber, permanent distortion under compression may increase. When permanent distortion under compression generates in the pressing roller, a part of the pressing roller may have a concave shape. Consequently, the nip portion may not have a desired nip length, generating faulty fixing or noise in accordance with rotation of the pressing roller.

By contrast, according to this exemplary embodiment, the heat insulator 27 is provided between the fixed member 26 and the heating member 22. Accordingly, heat is not transmitted from the heating member 22 to the fixed member 26 easily in the standby mode. Consequently, the deformed pressing roller 31 may not be heated in the standby mode, suppressing the above-described problems.

The lubricant applied between the fixed member 26 and the fixing belt 21 to decrease friction resistance may degrade due to high pressure and temperature at the nip portion N. As a result, the fixing belt 21 may slip on the fixed member 26.

To address this, according to this exemplary embodiment, the heat insulator 27 is provided between the fixed member 26 and the heating member 22 to prevent heat from transmitting from the heating member 22 to the lubricant applied at the nip portion N easily. Accordingly, the lubricant may not degrade due to high temperature easily, suppressing the above-described problems.

The heat insulator 27 provided between the fixed member 26 and the heating member 22 insulates the fixed member 26 from the heating member 22. Thus, the fixing belt 21 is not heated easily at the nip portion N. Accordingly, when a transfer sheet P is sent out of the nip portion N, temperature of the transfer sheet P is lower than temperature of the transfer sheet P when the transfer sheet P is sent into the nip portion N. In other words, when the transfer sheet P passes through the exit of the nip portion N, a toner image T fixed on the transfer sheet P has a lower temperature and a lower viscosity of toner. Accordingly, in a state in which the toner image T on the transfer sheet P adheres to the fixing belt 21 with a decreased adhering force, the transfer sheet P separates from the fixing belt 21. Consequently, the transfer sheet P immediately after fixing may not wrap the fixing belt 21 and jam. Further, toner may not adhere to the fixing belt 21.

As illustrated in FIGS. 4 and 8, in the fixing device 20 according to this exemplary embodiment, the low-friction sheet member 26*a* wraps a portion of the body 26*b* of the fixed member 26 facing the nip portion N in the sliding direction of the fixing belt 21 sliding over the fixed member 26. The plate spring 26*d* holds opposed ends of the low-friction sheet member 26*a* in the sliding direction of the fixing belt 21 with an elastic force and applies a predetermined tension to the low-friction sheet member 26*a*.

Specifically, the low-friction sheet member 26*a* wraps the body 26*b* and the stay 26*c* in such a manner that the low-friction sheet member 26*a* has a substantially U-shape and the opposed ends of the low-friction sheet member 26*a* in the sliding direction of the fixing belt 21 are disposed at a position inside the stay 26*c* on a side of the fixed member 26 opposite to another side facing the nip portion N. The plate spring 26*d* holds the opposed ends of the low-friction sheet member 26*a* in the sliding direction of the fixing belt 21. An elastic force of the plate spring 26*d* applies a predetermined tension to the low-friction sheet member 26*a*.

As illustrated in FIG. 8, a region A in which the plate spring 26*d* and the stay 26*c* sandwich the low-friction sheet member 26*a* serves as a holding portion or a pressing portion for holding the low-friction sheet member 26*a* with respect to the stay 26*c* in a state in which the low-friction sheet member 26*a* is not adhered to the fixed member 26 (e.g., the stay 26*c*). In other words, the elastic force of the plate spring 26*d* presses the low-friction sheet member 26*a* against the stay 26*c* in the region A so that the low-friction sheet member 26*a* is held on the fixed member 26.

A region B in which the low-friction sheet member 26*a* contacts the plate spring 26*d* but does not contact the stay 26*c*, that is, a curved portion in which the plate spring 26*d* is deformed elastically, serves as a tension applying portion for applying a tension to the low-friction sheet member 26*a* held by the fixed member 26. In other words, the elastic force of the plate spring 26*d* applies a predetermined tension to the low-friction sheet member 26*a* in the region B. Elastic deformation of the plate spring 26*d* changes a tension applied to the low-friction sheet member 26*a*. Accordingly, even when a shock tension is applied to the low-friction sheet member 26*a* in the sliding direction of the fixing belt 21 for sliding over the fixed member 26, that is, in a sheet conveyance direction or a direction opposite to the sheet conveyance direction, instant, elastic deformation of the plate spring 26*d* adjusts and balances a tension applied to the low-friction sheet member 26*a*. Accordingly, the low-friction sheet member 26*a* may not be twisted or warped.

As illustrated in FIG. 4, the stay 26*c* has an inverted C-like shape and includes a metal material such as stainless steel. The stay 26*c* is fixedly provided on the body 26*b* with an adhesive, for example.

As illustrated in FIG. 5, a stainless steel (SUS 304) plate having a thickness in a range from about 0.1 mm to about 0.3 mm is bent into the plate spring 26*d*. The hole 26*d*H is provided in a center of the plate spring 26*d* so that a screw portion of the screw 26*e* depicted in FIG. 4 is inserted into the hole 26*d*H. A tension applied by the plate spring 26*d* to the low-friction sheet member 26*a* depicted in FIG. 4 is adjustable. Specifically, a screw depth of the screw 26*e* for engaging a female thread provided in the stay 26*c* depicted in FIG. 4 via the plate spring 26*d* is adjusted to change an elastic deformation amount of the plate spring 26*d* pressed against a screw head of the screw 26*e*. Thus, a tension applied to the low-friction sheet member 26*a* in the region B depicted in FIG. 8, that is, in the tension applying portion, is adjusted. The above-described structure for adjusting a tension applied to the low-friction sheet member 26*a* optimizes the tension applied to the low-friction sheet member 26*a* so as to suppress twist or warp of the low-friction sheet member 26*a* precisely.

As illustrated in FIG. 6A, a plurality of plate springs 26*d* is provided in the width direction of the fixed member 26, that is, in a direction perpendicular to the sliding direction of the fixing belt 21 sliding over the fixed member 26. Accordingly, a tension applied to the low-friction sheet member 26*a* is adjusted at a plurality of positions in the width direction of the fixed member 26. According to this exemplary embodiment, the plurality of plate springs 26*d* is provided in the width direction of the fixed member 26 as illustrated in FIG. 6A. Alternatively, when a tension applied to the low-friction sheet member 26*a* needs not be adjusted at the plurality of positions in the width direction of the fixed member 26, the single plate spring 26*d* may extend in the width direction of the fixed member 26 as illustrated in FIG. 6B.

As illustrated in FIGS. 7A and 7B, according to this exemplary embodiment, when the plate spring 26*d* is assembled into the fixed member 26, a tension applied to the low-friction sheet member 26*a* is increased gradually in a state in which the plate spring 26*d* holds the opposed ends of the low-friction sheet member 26*a* wrapped around the fixed member 26 in the sliding direction of the fixing belt 21.

Specifically, as illustrated in FIG. 7A, when the plate spring 26*d* is assembled into the fixed member 26 in a manufacturing process, the plate spring 26*d* is pressed against the fixed member 26 in a state in which the plate spring 26*d* and the stay 26*c* sandwich and hold the opposed ends of the low-friction sheet member 26*a* wrapped around the fixed member 26 in the sliding direction of the fixing belt 21. In this state, the plate spring 26*d* is not pressed by the screw 26*e*. Thereafter, as illustrated in FIG. 7B, the screw 26*e* gradually deforms the plate spring 26*d* elastically as engagement of the screw 26*e* with the plate spring 26*d* proceeds. Accordingly, the plate spring 26*d* gradually increases a tension applied to the low-friction sheet member 26*a*. When the tension of the low-friction sheet member 26*a* is optimized, engagement of the screw 26*e* with the plate spring 26*d* is finished.

As described above, at first, the plate spring 26*d* holds the low-friction sheet member 26*a* by applying a slight tension to the low-friction sheet member 26*a*. Thereafter, the plate spring 26*d* gradually adds a tension from the opposed ends of the low-friction sheet member 26*a* in the sliding direction of the fixing belt 21 by balancing the tension. Thus, the low-friction sheet member 26*a* is stretched properly without being creased.

According to this exemplary embodiment, a plate is bent into the plate spring 26*d*. Alternatively, the plate spring 26*d* may be manufactured in other method by using elastic force of a material.

The low-friction sheet member 26*a* is a substantially rectangular sheet member including fluorocarbon resin fiber mesh. The fluorocarbon resin fiber may include low-friction fluorocarbon fiber such as PFA and/or PTFE, and/or fiber coated with fluorocarbon resin on a surface of glass cloth. The fluorocarbon resin fiber is woven into the mesh-shaped low-friction sheet member 26*a*. The mesh-shaped low-friction sheet member 26*a* includes holes between fibers, which decrease a slide area in which the fixing belt 21 slides over the low-friction sheet member 26*a* to decrease slide resistance. Further, the holes between fibers retain a lubricant so that the fixing belt 21 slides over the low-friction sheet member 26*a* properly over time.

The low-friction sheet member 26*a* includes a mesh formed of fluorocarbon resin fibers woven to intersect at right angles. Directions of the fluorocarbon resin fibers intersecting at right angles are tilted with respect to the sliding direction of the fixing belt 21 sliding over the low-friction sheet member 26*a* and a width direction of the fixing belt 21, that is, the axial direction of the fixing belt 21, perpendicular to the sliding direction of the fixing belt 21, respectively. According to this exemplary embodiment, the low-friction sheet member 26*a* is disposed in such a manner that the directions of the fluorocarbon resin fibers intersecting at right angles are tilted at about 45 degrees. In other words, the low-friction sheet member 26*a* is set in such a manner that mesh directions, that is, the directions of the fluorocarbon resin fibers intersecting at right angles, do not coincide with the sliding direction of the fixing belt 21 sliding over the low-friction sheet member 26*a* and the width direction of the fixing belt 21 perpendicular to the sliding direction of the fixing belt 21. Accordingly, the fibers do not tilt toward the sliding direction or the width direction of the fixing belt 21, suppressing damage to the low-friction sheet member 26*a* and the fixing belt 21.

The low-friction sheet member 26*a* does not include holes through which the low-friction sheet member 26*a* is attached to the fixed member 26. As described above, the elastic force of the plate spring 26*d* retains the low-friction sheet member 26*a* held by the fixed member 26. In other words, no adhesive is used to retain the low-friction sheet member 26*a* held by the fixed member 26. The low-friction sheet member 26*a* may contain a lubricant.

As described above, in the fixing device 20 (depicted in FIG. 4) according to this exemplary embodiment, the plate spring 26*d* retains the low-friction sheet member 26*a* held by the fixed member 26 in a limited space near the nip portion N without adhering the low-friction sheet member 26*a* to the fixed member 26 with an adhesive or providing holes in the low-friction sheet member 26*a* to attach the low-friction sheet member 26*a* to the fixed member 26 using the holes. Namely, the plate spring 26*d* applies a tension to the low-friction sheet member 26*a* to retain the low-friction sheet member 26*a* held by the fixed member 26 precisely without twisting or warping the low-friction sheet member 26*a*.

Figure 9:
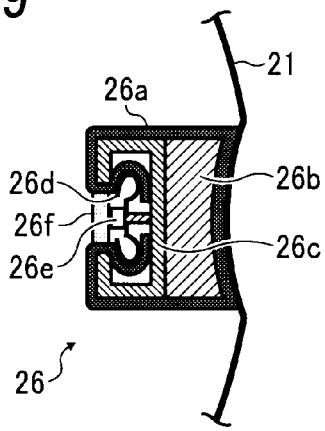
FIG. 9 is an axial end view of a fixing belt and a fixed member included in the fixing device shown in FIG. 4 when a seal member is attached to the fixed member.

The fixing device 20 may further include a seal member to prevent a lubricant from entering a gap between the plate spring 26*d* and the low-friction sheet member 26*a*. Referring to FIG. 9, the following describes such seal member. FIG. 9 is an axial end view of the fixing belt 21 and the fixed member 26. As illustrated in FIG. 9, the fixed member 26 further includes a seal member 26*f*.

The seal member 26*f* is a heat-resistant elastic body including fluorocarbon rubber and/or silicon rubber. The seal member 26*f* closely contacts the low-friction sheet member 26*a* to block an opening of the stay 26*c*. Accordingly, the seal member 26*f* breaks a path through which the lubricant applied between the fixing belt 21 and the low-friction sheet member 26*a* at the nip portion N and contained in the mesh of the low-friction sheet member 26*a* enters a contact portion in which the plate spring 26*d* contacts the low-friction sheet member 26*a* (e.g., the regions A and B depicted in FIG. 8). Consequently, the lubricant does not reach the region A in which the plate spring 26*d* contacts the low-friction sheet member 26*a* contacting the stay 26*c*, and therefore does not decrease friction resistance of the low-friction sheet member 26*a*, the stay 26*c*, and the plate spring 26*d*. Thus, the low-friction sheet member 26*a* is retained between the plate spring 26*d* and the stay 26*c* in the region A.

According to this exemplary embodiment, the seal member 26*f* is provided separately from the low-friction sheet member 26*a*. Alternatively, the low-friction sheet member 26*a* may include a seal member. For example, holes of the mesh in the opposed ends of the low-friction sheet member 26*a* in the sliding direction of the fixing belt 21 in a contact portion in which the plate spring 26*d* contacts the low-friction sheet member 26*a* are filled in to prevent the lubricant from entering the contact portion.

The screw 26*e* may secure the seal member 26*f* and the plate spring 26*d* to the stay 26*c*.

Figure 10:
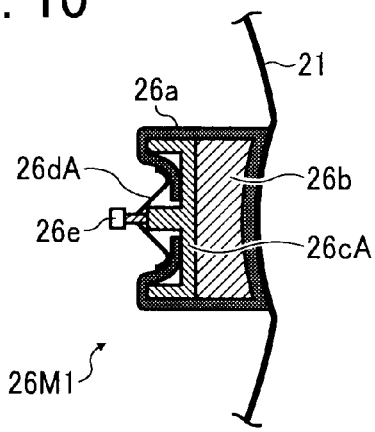
FIG. 10 is an axial end view of one modified example of the fixed member shown in FIG. 7B.
Figure 11:
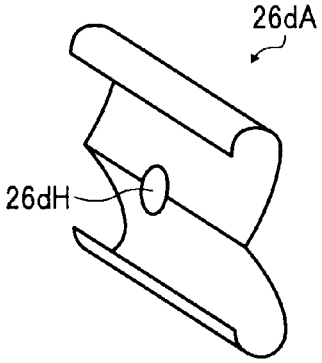
FIG. 11 is a perspective view of a plate spring included in the fixed member shown in FIG. 10.
Figure 12:
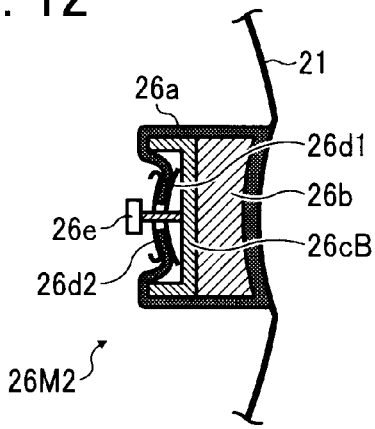
FIG. 12 is an axial end view of another modified example of the fixed member shown in FIG. 7B.

The structure of the fixed member including the plate spring is not limited to the structure of the fixed member 26 described above, and various modifications are available. Referring to FIGS. 10 to 12, the following describes modified examples of the fixed member 26. FIG. 10 is an axial end view of the fixing belt 21 and a fixed member 26M1 as one modified example. As illustrated in FIG. 10, the fixed member 26M1 includes the low-friction sheet member 26*a*, the body 26*b*, a stay 26*c*A, a plate spring 26*d*A, and the screw 26*e*. FIG. 11 is a perspective view of the plate spring 26*d*A. As illustrated in FIG. 11, the plate spring 26*d*A includes the hole 26*d*H.

As illustrated in FIG. 10, the stay 26*c*A has an inverted E-like shape. A height (e.g., an elastic deformation amount) of the plate spring 26*d*A is lower than a height of the plate spring 26*d* depicted in FIG. 8.

FIG. 12 is an axial end view of the fixing belt 21 and a fixed member 26M2 as another modified example. As illustrated in FIG. 12, the fixed member 26M2 includes the low-friction sheet member 26*a*, the body 26*b*, a stay 26*c*B, plate springs 26*d*1 and 26*d*2, and the screw 26*e*.

The stay 26*c*B has a U-like shape. The two bow-shaped plate springs 26*d*1 and 26*d*2 sandwich the opposed ends of the low-friction sheet member 26*a* in the sliding direction of the fixing belt 21. The screw 26*e* screws and presses the plate springs 26*d*1 and 26*d*2 and the opposed ends of the low-friction sheet member 26*a* in the sliding direction of the fixing belt 21 against the stay 26*c*B.

With the above-described structures, the fixed members 26M1 and 26M2 provide effects equivalent to the effects provided by the fixed member 26 depicted in FIG. 4.

As described above, even when the inner circumferential surface of the fixing belt 21 slides over the fixed member 26, 26M1, or 26M2 via the low-friction sheet member 26*a*, the plate spring 26*d*, 26*d*A, or 26*d*1 and 26*d*2 presses the opposed ends of the low-friction sheet member 26*a* in the sliding direction of the fixing belt 21 against the body 26*b*. In other words, the plate spring 26*d*, 26*d*A, or 26*d*1 and 26*d*2 holds the opposed ends of the low-friction sheet member 26*a* in the sliding direction of the fixing belt 21 with the elastic force and applies a predetermined tension to the low-friction sheet member 26*a* wrapped around the fixed member 26, 26M1, or 26M2 to cover a portion of the fixed member 26, 26M1, or 26M2 opposing the nip portion N. Accordingly, even when the low-friction sheet member 26*a* is disposed in a relatively small space, the low-friction sheet member 26*a* may not be twisted or warped.

Especially, when the fixed member 26, 26M1, or 26M2 is disposed inside a fixing member (e.g., the fixing belt 21) provided with a heater to apply heat to a transfer sheet P bearing a toner image T, the above-described effects may be beneficial because the twisted or warped low-friction sheet member 26*a* may affect the toner image T more adversely compared to when the fixed member 26, 26M1, or 26M2 is disposed inside a pressing member (e.g., the pressing roller 31 depicted in FIG. 2) not provided with a heater to apply pressure to the transfer sheet P bearing the toner image T.

In the fixing device 20 depicted in FIG. 4, the fixing belt 21 having a plurality of layers serves as a belt member. Alternatively, an endless fixing film including polyimide, polyamide, fluorocarbon resin, and/or metal may be used as a belt member to provide effects equivalent to the effects provided by the fixing belt 21.

Figure 13:
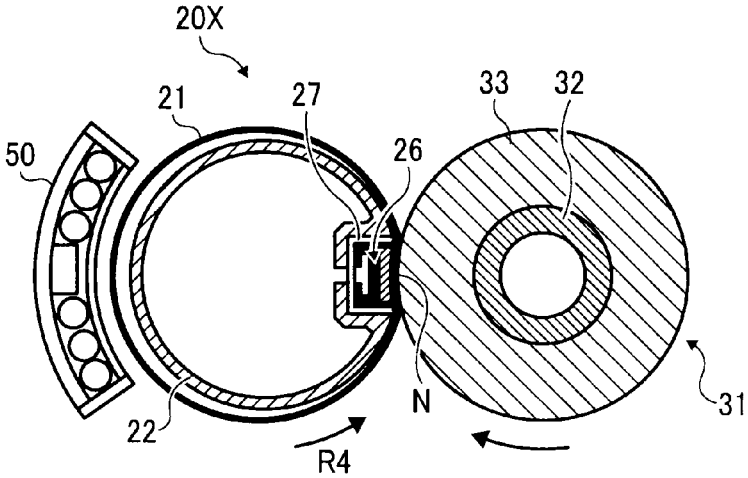
FIG. 13 is a schematic view of a fixing device according to another exemplary embodiment of the present invention.

Referring to FIG. 13, the following describes a fixing device 20X according to another exemplary embodiment. FIG. 13 is a schematic view of the fixing device 20X. As illustrated in FIG. 13, the fixing device 20X includes the fixing belt 21, the heating member 22, the fixed member 26, the heat insulator 27, the pressing roller 31, and an induction heater 50. The pressing roller 31 includes the core metal 32 and the elastic layer 33. Like the fixing device 20 depicted in FIG. 2, in the fixing device 20X, the fixed member 26 includes the low-friction sheet member 26*a*, the body 26*b*, the stay 26*c*, the plate spring 26*d*, and the screw 26*e* depicted in FIG. 4.

The plate spring 26*d* holds and stretches the low-friction sheet member 26*a* wrapped around the surface of the fixed member 26. Namely, the fixing device 20X is different from the fixing device 20 in that the heating member 22 is heated by the induction heater 50 serving as a heater provided outside the fixing belt 21 by induction heating, not by the heater 25 depicted in FIG. 2.

As illustrated in FIG. 13, the fixing device 20X includes the induction heater 50 replacing the heater 25 depicted in FIG. 2. Unlike the heating member 22 of the fixing device 20 which is heated by radiation heat generated by the heater 25, the heating member 22 of the fixing device 20X is heated by induction heating generated by the induction heater 50.

The induction heater 50 includes an exciting coil, a core, and a coil guide. The exciting coil includes litz wire formed of bundled thin wires, which extends in a width direction of the induction heater 50, that is, in the axial direction of the fixing belt 21 so as to cover a part of the fixing belt 21. The coil guide includes a heat-resistant resin material, and supports the exciting coil and the core. The core is a semicylindrical member including a ferromagnet, such as ferrite, having a relative magnetic permeability in a range from about 1,000 to about 3,000. The core includes a center core and a side core to generate a magnetic flux toward the heating member 22 effectively. The core opposes the exciting coil extending in the width direction of the induction heater 50.

The following describes operations of the fixing device 20X having the above-described structure. When the fixing belt 21 rotates in a rotation direction R4, the fixing belt 21 is heated by the induction heater 50 at an opposing position at which the fixing belt 21 opposes the induction heater 50. Specifically, a high-frequency alternating current is applied to the exciting coil of the induction heater 50 to generate magnetic lines of force around the heating member 22 in such a manner that directions of the magnetic lines of force are alternately switched bidirectionally. Accordingly, an eddy current generates on a surface of the heating member 22, and electric resistance of the heating member 22 generates Joule heat. The Joule heat heats the heating member 22 by induction heating. The heated heating member 22 heats the fixing belt 21.

In order to heat the heating member 22 by induction heating effectively, the induction heater 50 may oppose the heating member 22 in a whole circumferential direction of the heating member 22. The heating member 22 may include nickel, stainless steel, iron, copper, cobalt, chrome, aluminum, gold, platinum, silver, tin, palladium, and/or alloy including a plurality of the above metals.

As described above, in the fixing device 20X, like in the fixing device 20 depicted in FIG. 4, even when the inner circumferential surface of the fixing belt 21 slides over the fixed member 26 via the low-friction sheet member 26*a*, the plate spring 26*d* presses the opposed ends of the low-friction sheet member 26*a* in the sliding direction of the fixing belt 21 against the body 26*b*. In other words, the plate spring 26*d* holds the opposed ends of the low-friction sheet member 26*a* wrapped around the fixed member 26 in the sliding direction of the fixing belt 21 to cover the surface of the fixed member 26 opposing the nip portion N with the elastic force and applies a predetermined tension to the low-friction sheet member 26*a*. Thus, the low-friction sheet member 26*a* provided in the relatively small space may not be twisted or warped.

Instead of the fixed member 26, the fixing device 20X may include the fixed member 26M1 depicted in FIG. 10 or the fixed member 26M2 depicted in FIG. 12.

In the fixing device 20X, the heating member 22 is heated by induction heating. Alternatively, the heating member 22 may be heated by heat generated by a resistance heat generating body. For example, the resistance heat generating body contacts a part or a whole portion of an inner circumferential surface of the heating member 22. The resistance heat generating body may be a sheet-shaped heat generating body such as a ceramic heater. Both ends of the resistance heat generating body are connected to a power source. When an electric current is applied to the resistance heat generating body, electric resistance of the resistance heat generating body increases temperature of the resistance heat generating body and heats the heating member 22 contacting the resistance heat generating body. Accordingly, the heated heating member 22 heats the fixing belt 21.

Alternatively, the heating member 22 may be a resistance heat generating body. For example, the heating member 22 may be a thin resistance heat generating body, and a power source may be connected to both ends of the thin resistance heat generating body. When an electric current is applied to the heating member 22 serving as the resistance heat generating body, electric resistance of the heating member 22 increases temperature of the resistance heat generating body so as to heat the fixing belt 21.

The above-described alternative structures may include a fixed member equivalent to the fixed member 26, 26M1, or 26M2 to provide effects equivalent to the effects provided by the fixed member 26, 26M1, or 26M2.

Figure 14:
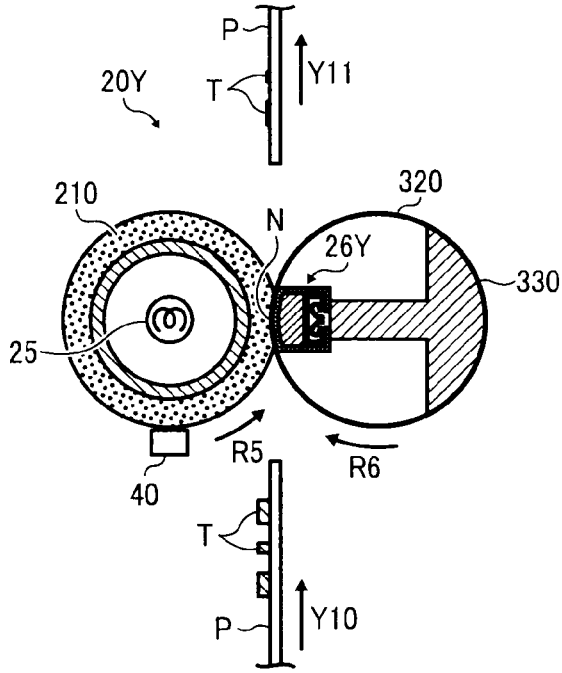
FIG. 14 is a schematic view of a fixing device according to yet another exemplary embodiment of the present invention.

Referring to FIG. 14, the following describes a fixing device 20Y according to yet another exemplary embodiment. FIG. 14 is a schematic view of the fixing device 20Y. As illustrated in FIG. 14, the fixing device 20Y includes the heater 25, a fixed member 26Y, the temperature sensor 40, a fixing roller 210, a pressing belt 320, and a reinforcement member 330.

The pressing belt 320 serves as a belt member. The fixing roller 210 serves as a rotary member or a fixing member. The heater 25 is provided inside the fixing roller 210. The fixed member 26Y (e.g., a pressing pad) is pressed against the fixing roller 210 via the pressing belt 320 to form a nip portion N between the fixing roller 210 and the pressing belt 320. The reinforcement member 330 maintains a shape of the pressing belt 320 and reinforces the fixed member 26Y.

The heater 25 heats the fixing roller 210. When a transfer sheet P bearing a toner image T passes through the nip portion N formed between the fixing roller 210 rotating in a rotation direction R5 and the pressing belt 320 rotating in a rotation direction R6, the fixing roller 210 and the pressing belt 320 apply heat and pressure to the transfer sheet P to fix the toner image T on the transfer sheet P.

In the fixing device 20Y, the fixed member 26Y serves as a pressing pad. However, a structure of the fixed member 26Y is equivalent to the structure of the fixed member 26 depicted in FIG. 4 or 13, the fixed member 26M1 depicted in FIG. 10, or the fixed member 26M2 depicted in FIG. 12. In other words, in the fixing device 20Y also, the fixed member 26Y includes the low-friction sheet member 26*a*, the body 26*b*, the stay 26*c*, 26*c*A, or 26*c*B, the plate spring 26*d*, 26*d*A, or 26*d*1 and 26*d*2, and the screw 26*e*. The plate spring 26*d*, 26*d*A, or 26*d*1 and 26*d*2 holds and stretches the low-friction sheet member 26*a* wrapped around the surface of the fixed member 26Y. Thus, the low-friction sheet member 26*a* may not be twisted or warped.

Figure 15:
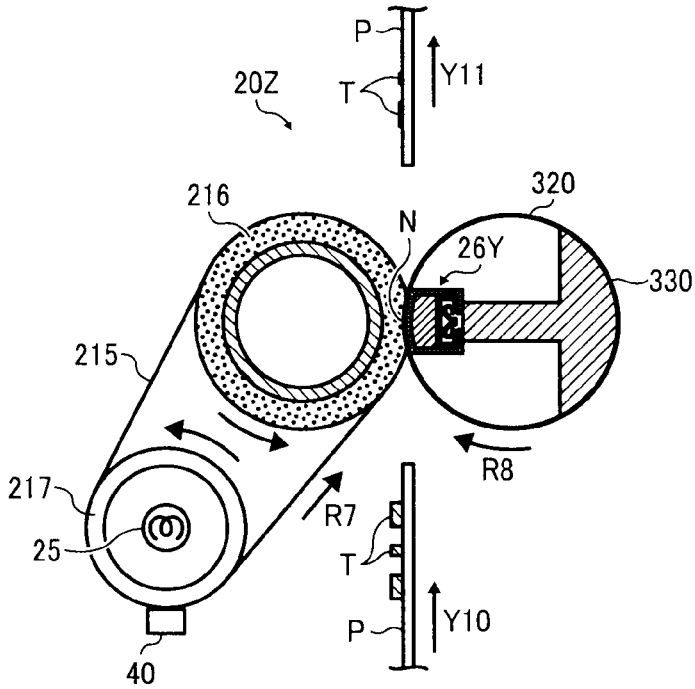
FIG. 15 is a schematic view of a fixing device according to yet another exemplary embodiment of the present invention.

Referring to FIG. 15, the following describes a fixing device 20Z according to yet another exemplary embodiment. FIG. 15 is a schematic view of the fixing device 20Z. As illustrated in FIG. 15, the fixing device 20Z includes the heater 25, the fixed member 26Y, the temperature sensor 40, a fixing belt 215, rollers 216 and 217, the pressing belt 320, and the reinforcement member 330.

The pressing belt 320 serves as a belt member. The fixing belt 215 serves as a rotary member, and is stretched over the two rollers 216 and 217. The heater 25 is provided inside the roller 217. The fixed member 26Y (e.g., a pressing pad) is pressed against the roller 216 via the fixing belt 215 and the pressing belt 320 to form a nip portion N between the fixing belt 215 and the pressing belt 320. The reinforcement member 330 maintains the shape of the pressing belt 320 and reinforces the fixed member 26Y.

The heater 25 indirectly heats the fixing belt 215 via the roller 217. When a transfer sheet P bearing a toner image T passes through the nip portion N formed between the fixing belt 215 rotating in a rotation direction R7 and the pressing belt 320 rotating in a rotation direction R8, the fixing belt 215 and the pressing belt 320 apply heat and pressure to the transfer sheet P to fix the toner image T on the transfer sheet P.

In the fixing device 20Z, the fixed member 26Y serves as a pressing pad. However, the structure of the fixed member 26Y is equivalent to the structure of the fixed member 26 depicted in FIG. 4 or 13, the fixed member 26M1 depicted in FIG. 10, or the fixed member 26M2 depicted in FIG. 12. In other words, in the fixing device 20Z also, the fixed member 26Y includes the low-friction sheet member 26*a*, the body 26*b*, the stay 26*c*, 26*c*A, or 26*c*B, the plate spring 26*d*, 26*d*A, or 26*d*1 and 26*d*2, and the screw 26*e*. The plate spring 26*d*, 26*d*A, or 26*d*1 and 26*d*2 holds and stretches the low-friction sheet member 26*a* wrapped around the surface of the fixed member 26Y. Thus, the low-friction sheet member 26*a* may not be twisted or warped.

As described above, in the fixing devices 20Y depicted in FIG. 14 and the fixing device 20Z depicted in FIG. 15, even when an inner circumferential surface of the pressing belt 320 slides over the fixed member 26Y via the low-friction sheet member 26*a*, the plate spring 26*d*, 26*d*A, or 26*d*1 and 26*d*2 presses the opposed ends of the low-friction sheet member 26*a* wrapped around the fixed member 26Y in a sliding direction of the pressing belt 320 sliding over the fixed member 26Y against the body 26*b*. In other words, the plate spring 26*d*, 26*d*A, or 26*d*1 and 26*d*2 holds the opposed ends of the low-friction sheet member 26*a* in the sliding direction of the pressing belt 320 with an elastic force in such a manner that the low-friction sheet member 26*a* covers a surface of the fixed member 26Y opposing the nip portion N. Further, the plate spring 26*d*, 26*d*A, or 26*d*1 and 26*d*2 applies a predetermined tension to the low-friction sheet member 26*a*. Thus, even when the fixed member 26Y is provided in a relatively small space, the low-friction sheet member 26*a* may not be twisted or warped.

As described above, a fixing device (e.g., the fixing device 20, 20X, 20Y, or 20Z depicted in FIG. 4, 13, 14, or 15, respectively) installed in an image forming apparatus (e.g., the image forming apparatus 1 depicted in FIG. 1) includes a fixed member (e.g., the fixed member 26, 26M1, 26M2, or 26Y depicted in FIG. 4, 10, 12, or 14, respectively). The fixed member includes a low-friction sheet member (e.g., the low-friction sheet member 26*a* depicted in FIGS. 8 to 10, and 12) and a plate spring (e.g., the plate spring 26*d*, 26*d*A, or 26*d*1 and 26*d*2 depicted in FIG. 8, 10, or 12, respectively).

Even when an inner circumferential surface of a belt member (e.g., the fixing belt 21 depicted in FIGS. 4, 9, 10, 12, and 13 or the pressing belt 320 depicted in FIGS. 14 and 15) slides over the fixed member via the low-friction sheet member, the plate spring presses the low-friction sheet member wrapped around a body (e.g., the body 26*b* depicted in FIGS. 4, 9, 10, and 12) in a sliding direction in which the belt member slides over the fixed member against the body with an elastic force in such a manner that the low-friction sheet member covers a surface of the body opposing a nip portion (e.g., the nip portion N depicted in FIGS. 4, and 13 to 15). For example, the plate spring presses opposed ends of the low-friction sheet member disposed in the sliding direction of the belt member against the body. Further, the plate spring applies a predetermined tension to the low-friction sheet member. Thus, even when the fixed member is provided in a relatively small space, the low-friction sheet member may not be twisted or warped.

According to the above-described exemplary embodiments, the low-friction sheet member has a sheet shape. Alternatively, the low-friction sheet member may have other shape such as an endless belt shape. In this case, the plate spring may press a part of the endless belt-shaped, low-friction sheet member against the body.

In the above-described exemplary embodiments, when the fixed member is "fixedly provided", the fixed member is held or supported without being rotated. Therefore, even when a biasing member such as a spring presses the fixed member against the nip portion, for example, the fixed member is "fixedly provided" as long as the fixed member is held or supported without being rotated.

The present invention has been described above with reference to specific exemplary embodiments. Note that the present invention is not limited to the details of the embodiments described above, but various modifications and enhancements are possible without departing from the spirit and scope of the invention. It is therefore to be understood that the present invention may be practiced otherwise than as specifically described herein. For example, elements and/or features of different illustrative exemplary embodiments may be combined with each other and/or substituted for each other within the scope of the present invention.

What is claimed is:

1. A fixing device for fixing a toner image on a recording medium, comprising:

an endless belt member to rotate in a predetermined direction;

a rotary member in rotatable contact with an outer circumferential surface of the belt member; and a fixed member provided inside a loop formed by the belt member over which an inner circumferential surface of the belt member slides, the fixed member pressed against the rotary member via the belt member to form a nip portion between the rotary member and the belt member through which the recording medium bearing the toner image passes, the fixed member comprising:

a body opposing the nip portion;

a low-friction sheet member wrapped around the body of the fixed member in a sliding direction in which the belt member slides over the fixed member, in such a manner that the low-friction sheet member covers a surface of the body opposing the nip portion; and at least one plate spring contacting an outer circumferential surface of the low-friction sheet member to press the low-friction sheet member against the body with an elastic force to apply a predetermined tension to the low-friction sheet member.

2. The fixing device according to claim 1, wherein the at least one plate spring presses opposed ends of the low-friction sheet member disposed in the sliding direction of the belt member against the body.

3. The fixing device according to claim 1, wherein the tension applied to the low-friction sheet member by the at least one plate spring is adjustable.

4. The fixing device according to claim 3, wherein the tension applied to the low-friction sheet member by the at least one plate spring after the at least one plate spring presses the opposed ends of the low-friction sheet member wrapped around the body in the sliding direction of the belt member against the body is increased.

5. The fixing device according to claim 1, wherein a plurality of plate springs is provided in a direction perpendicular to the sliding direction of the belt member.

6. The fixing device according to claim 1, wherein the fixed member further comprises a seal member provided near the at least one plate spring.

7. The fixing device according to claim 1, wherein the low-friction sheet member comprises a mesh formed of fluorocarbon resin fibers.

8. The fixing device according to claim 7, wherein the fluorocarbon resin fibers are woven to intersect at right angles, and directions of the fluorocarbon resin fibers intersecting at right angles are tilted with respect to the sliding direction of the belt member and a direction perpendicular to the sliding direction of the belt member, respectively.

9. The fixing device according to claim 1, wherein the body has a generally rectangular shape, long sides of the rectangular shape disposed perpendicular to the sliding direction of the belt member.

10. The fixing device according to claim 1, further comprising a heater provided inside or outside at least one of the belt member and the rotary member to heat at least one of the belt member and the rotary member.

11. The fixing device according to claim 10, further comprising a heat insulator provided between the fixed member and the heater, wherein the heater heats the belt member at a position other than the nip portion.

12. The fixing device according to claim 10, further comprising a heating member opposing the inner circumferential surface of the belt member at a position other than the nip portion, and heated by the heater directly, wherein the belt member comprises one of a fixing belt and a fixing film to heat and melt the toner image on the recording medium, and the rotary member comprises a pressing roller.

13. The fixing device according to claim 10, wherein the rotary member comprises one of a fixing roller and a fixing belt heated by the heater, and the belt member comprises a pressing belt.

14. An image forming apparatus comprising:

a fixing device to fix a toner image on a recording medium, comprising:

an endless belt member to rotate in a predetermined direction;

a rotary member in rotatable contact with an outer circumferential surface of the belt member; and a fixed member provided inside a loop formed by the belt member over which an inner circumferential surface of the belt member slides, the fixed member pressed against the rotary member via the belt member to form a nip portion between the rotary member and the belt member through which the recording medium bearing the toner image passes, the fixed member comprising:

a body opposing the nip portion;

a low-friction sheet member wrapped around the body of the fixed member in a sliding direction in which the belt member slides over the fixed member, in such a manner that the low-friction sheet member covers a surface of the body opposing the nip portion; and at least one plate spring contacting an outer circumferential surface of the low-friction sheet member to press the low-friction sheet member against the body with an elastic force to apply a predetermined tension to the low-friction sheet member.

15. A fixing device for fixing a toner image on a recording medium, comprising:

an endless belt member to rotate in a predetermined direction;

a rotary member in rotatable contact with an outer circumferential surface of the belt member; and a fixed member provided inside a loop formed by the belt member over which an inner circumferential surface of the belt member slides, the fixed member pressed against the rotary member via the belt member to form a nip portion between the rotary member and the belt member through which the recording medium bearing the toner image passes, the fixed member comprising:

a body opposing the nip portion;

a low-friction sheet member wrapped around the body of the fixed member in a sliding direction in which the belt member slides over the fixed member, in such a manner that the low-friction sheet member covers a surface of the body opposing the nip portion; and at least one plate spring to press the low-friction sheet member against the body with an elastic force to apply a predetermined tension to the low-friction sheet member, wherein the tension applied to the low-friction sheet member by the at least one plate spring is adjustable.

* * * * *